US005453216A

United States Patent [19]

Kellett

[11] Patent Number: 5,453,216

[45] Date of Patent: Sep. 26, 1995

[54] DELAYED-RELEASE ENCAPSULATED WAREWASHING COMPOSITION AND PROCESS OF USE

[75] Inventor: George W. Kellett, Cranford, N.J.

[73] Assignee: Creative Products Resource, Inc., North Caldwell, N.J.

[21] Appl. No.: 234,180

[22] Filed: Apr. 28, 1994

[51] Int. Cl.[6] ..... C11D 17/00; C11D 1/66; C11D 3/12; B08B 3/02

[52] U.S. Cl. ..... 252/174.13; 252/DIG. 1; 252/DIG. 2; 252/174.23; 252/164; 252/165; 252/544; 252/140; 252/155; 252/109; 252/116; 252/130; 252/134; 252/525; 252/96; 252/97; 252/98; 252/186.25; 252/113; 252/DIG. 12; 252/133; 252/135; 134/25.2; 134/40

[58] Field of Search ..... 134/25.2, 40, 42; 252/174.13, 155, DIG. 1, 109, 110, DIG. 3, 112, DIG. 2, 115, 135, 116, 130, 174.23, 133, 164, 134, 165, 525, 163, 96, 168, 97, 169, 98, 544, 99, 186.2, 153, 186.25, 154, 140, 113, DIG. 12

[56] References Cited

U.S. PATENT DOCUMENTS

| | | | |
|---|---|---|---|
| 3,908,045 | 9/1975 | Alterman et al. | 427/213 |
| 4,078,099 | 3/1978 | Mazzola | 252/DIG. 1 |
| 4,759,956 | 7/1988 | Amer et al. | 427/174.13 X |
| 4,762,637 | 8/1988 | Aronson et al. | 252/174.13 X |
| 4,806,266 | 2/1989 | Burrill | 252/174.13 X |
| 4,972,017 | 11/1990 | Smith et al. | 524/174.13 X |
| 5,028,433 | 7/1991 | Ishimaru et al. | 424/464 |
| 5,133,892 | 7/1992 | Chun et al. | 252/174.13 X |
| 5,230,822 | 7/1993 | Kamel et al. | 252/174.13 |

*Primary Examiner*—Paul Lieberman
*Assistant Examiner*—Douglas J. McGinty
*Attorney, Agent, or Firm*—Schwegman, Lundberg & Woessner

[57] ABSTRACT

A delayed-release composite particle is provided which comprises (a) a core particle comprising an inorganic detergent builder salt and an effective amount of at least one wash additive; and (b) a waxy coating encapsulating said core particle, which coating has a melting point of greater than about 65° C. and which chemically disintegrates in aqueous solution at a temperature of less than about 65° C. and a pH of above about 9.0.

25 Claims, No Drawings

DELAYED-RELEASE ENCAPSULATED WAREWASHING COMPOSITION AND PROCESS OF USE

BACKGROUND OF THE INVENTION

In formulating warewashing ("dishwashing") detergent compositions for use in automatic dishwashing machines, it is often desirable to include specialized ingredients referred to as wash additives. Certain wash additives are preferably introduced into the rinse cycle after an alkaline detergent wash has occurred. Therefore, as used hereinafter, "wash additive" refers to those materials which are intended for use, are most efficacious in a rinse portion of a wash session, and are intended to improve the appearance, sanitation or cleanliness of the ware washed in a machine ("automatic") dishwashing apparatus. Such wash additives include, but are not limited to, bleaches, soil anti-redeposition agents, enzymes and the classes of surfactants or surfactant blends known as rinse aids. Rinse aids are used to decrease spotting and filming on previously washed dishes, glasses and other household items, aiding drying and enhancing shine.

The required sequential addition of washing detergent and rinse aid can be achieved by manually introducing the rinse aid into the dishwashing machine after the washing detergent has been added and the dishes washed. This process is inconvenient, however, and requires a consumer to purchase and handle separate products.

Sequential addition of these ingredients can also be achieved by providing separate compartments in the dishwasher that will open at different times during the wash session. Currently available dishwashing machines have two compartments—one which opens at the beginning of the pre-wash cycle, and another which opens at the start of the wash cycle. Providing additional compartments requires a substantial retrofit of existing machine types or the design of new ones, which can be a costly undertaking in either case.

To overcome these problems, a number of detergent compositions have been disclosed which are intended to provide the delayed release of one or more of the ingredients in situ during the washing session. For example, Smith et al. (U.S. Pat. No. 4,972,017 ) discloses core particles comprising wash additives such as bleach or surfactants that are coated with a blend of crosslinked polyvinyl alcohol and alkyl cellulose. The coating is disclosed to remain intact in the alkaline environment of the wash cycle, but to rapidly dissolve in the lower pH of the rinse cycle. Kamel et al. (U.S. Pat. No. 5,230,822) disclose encapsulating particles of a core material, such as an enzyme, which may be incompatible with other detergent components, such as bleach. The coating of low-melting paraffin wax which is employed to coat the core material is selected to melt so that the active core material is released into the wash cycle. K. W. Chun et al. (U.S. Pat. No. 5,133,892) disclose a detergent tablet having at least two coating layers. The tablet is intended to provide sequenced release of a dishwashing detergent composition from the outer layer and a rinse aid from the inner layer. A polymer barrier layer separates the two layers.

While delayed release compositions have been used in the detergent and dishwashing arts, none of the prior compositions provide the convenience and performance necessary to be accepted by consumers. Therefore, a continuing need exists for a dishwashing detergent composition which comprises both a dishwashing detergent component and a rinse aid, wherein the rinse aid is released alter the detergent cleaning has been initiated or accomplished.

SUMMARY OF THE INVENTION

The present invention provides a delayed-release composite particle, comprising a particulate core comprising one or more wash additives such as a rinse aid or bleach, wherein said core is encapsulated in a waxy surface coating. The coating is selected so that it does not melt at the temperatures encountered during the wash cycle of an automatic dishwashing machine, but gradually chemically disintegrates at the alkaline pHs of the wash cycle so that an effective amount of the wash additive survives the wash cycle and is delivered into the rinse cycle. As used herein, the term "an effective amount" of wash additive, such as a rinse aid is measured by the performance of a detergent composition comprising said delayed release particles versus that of a detergent composition without said particles, as exemplified hereinbelow.

The present invention also provides a finished detergent composition suitable for use in a dishwashing machine, comprising (a) a first particulate detergent composition comprising an alkaline builder salt capable of providing a washing solution having a pH of about 9 or greater during the washing cycle in said dishwashing machine, and (b) an amount of said delayed release composite particles which remain substantially intact at pH $\geqq 9$ and which can deliver an effective amount of at least one wash additive into the rinse cycle of the dishwashing machine. The particulate core of the present composite particles can also comprise conventional detergent components, such as builder salts and/or fillers, which can provide a support matrix for the wash additive or additives. Preferably, this composition will comprise about 5–50% composite particles in combination with about 50–95% of a non-coated particulate detergent composition.

More specifically the present delayed release composite particle comprises a barrier coating that is about 1–25%, preferably about 2.5–15% by weight of the composite particle, which encloses a core which represents about 75–99%, preferably 85–97.5%, by weight of the composite particle. The core, in turn, is formulated to comprise about 5–30%, preferably about 10–25% of total wash additive(s), e.g., 1–3 wash additives, and about 70–95% of a water-soluble support matrix, such as one or more builder or filler salts, e.g., 1–5 builder salts.

The polymer coating is preferably formed of one or more synthetic or semi synthetic waxy materials which do not liquify during the temperatures encountered during the wash (or rinse) cycle of the dishwashing machine, i.e., the coating remains essentially intact at below about 60°–65° C., and preferably, does not begin to melt until the temperature increases to above about 70°–75° C. However, the coating composition is selected so that it will chemically disintegrate, probably via saponification and/or soluble salt formation, at the pH attained during the wash cycle of the dishwashing machine, e.g., at a pH of greater than about 9, i.e., at about 9.5–12.5, and so will expose the core to the wash solution and/or rinse solution after a time-delay, which can be adjusted by adjusting the composition and thickness of the coating. Thus, the present particles can comprise thinner barrier coatings than prior art particles which rely on the thickness of a low-melting waxy coating to delay the release of the wash additive into the aqueous solutions formed in the dishwasher. For example, the composite particles disclosed by Kamel et al. have coatings that are about 50% of the total weight of the finished particle. The thinner coating of the present particles permit corresponding larger base particles, which can carry larger loads of active additives. The present film also does not rely on chemical crosslinking agents for their stability, which reduces the cost and complexity of their preparation.

As will be discussed in detail hereinbelow, preferred coating compositions comprise a mixture of a solid fatty acid or acids with a mixture of ethylene oxide esters of fatty acids, i.e., monoethylene oxide esters and polyethylene oxide esters of ($C_{16}$–$C_{22}$) fatty acids.

All percentages are weight percentages unless otherwise noted. The term "about" as related to temperatures refers to the variation in water temperatures during a cycle of a wash session, as described hereinbelow.

DETAILED DESCRIPTION OF THE INVENTION

The term "dishwashing cycle" as used herein refers to a prewash cycle, a prerinse cycle, a main wash cycle or a rinse cycle. A dishwashing session of a typical domestic dishwashing machine (such as Kenmore®, General Electric® or Kitchen Aid®) generally consists of at least prewash, prerinse, main wash and rinse cycles. As defined herein, the dishwashing session does not include the drying cycle. The average lengths of the prewash, prerinse, main wash and rinse cycles are on the average from 6 to 14 minutes, from 5 to 9 minutes, from 11 to 15 minutes and from 6 to 17 minutes, respectively.

Although each ingredient of the compositions described herein need not be water soluble, all inner components, barrier layers and other ingredients of the composition must dissolve, disperse, disintegrate or become dissipated in the aqueous cleaning environment of the dishwashing machine, so that essentially no residue remains in the dishwashing machine at the end of the dishwashing session. Therefore, generally, natural or synthetic waxes such as microcrystalline wax, paraffin waxes or polyethylene, as well as polyolefin latexes are not used as components of the coating composition.

The two-component machine dishwashing composition of the present invention is formulated to provide a pH of at least about 9.0, preferably a pH in the range of from 9.5 to 12.5, in an aqueous washing solution during a dishwashing cycle. The preferred non-encapsulated ingredients employed in the present invention are alkaline, and it is typically not necessary to use additional alkaline sources in order to adjust pH. However, if necessary, caustic agents, such as sodium hydroxide, may be additionally present.

Thus, suitable non-coated detergent ingredients of the present invention include particulate or powdered organic and/or inorganic builders such as alkali metal ortho-, pyro and tripolyphosphates and hexametaphosphates, silicates, carbonates, zeolites, borates, citrates, oxydisuccinates, carboxymethyloxsuccinates, nitrilotriacetates, citrates and ethylenediamine-tetraacetates, polymeric polyelectrolytes such as polyacrylates, polymaleates, polyacetates, other organic and inorganic builder compounds and mixtures thereof. The non-coated and coated components of the invention may be formulated in substantial absence of any phosphate builders.

In the preferred embodiments of this invention, sodium or potassium tripolyphosphate or sodium or potassium hexametaphosphate are used in both the core of the composite particles and the non-coated detergent component. Mixtures of these phosphate salts with carbonates and silicates are also especially preferred. Enzymes may be included in the non-coated detergent component, and may be of the amylolytic, proteolytic and lipolytic type or mixtures thereof. The enzyme particles may themselves be coated to inhibit their decomposition during storage with alkaline builder salts. Therefore, a suitable phosphate based detergent formulation includes sodium tripolyphosphate (35–45%), sodium silicate (15–20%), sodium carbonate (20–30%), sodium bicarbonate (15–25%), sodium percarbonate (7.5–12.5%), surfactant (1–3%), enzyme (1–3%), water (5–10%) and fragrance (0.1–0.3%). A suitable non-phosphate based detergent formulation can include sodium citrate dihydrate (30–40%), sodium silicate (15–20%), sodium carbonate (20–30%), sodium bicarbonate (15–25%), sodium percarbonate (7.5–12.5%), polyacrylate (3–7%), surfactant (1–3%), enzyme (1–3%) and fragrance (0.1–0.3%).

The particular choice of coating layer ingredients is determined by the disintegration rate of the layer at a temperature in the range of from 37° C. to about 70° C. in an aqueous alkaline cleaning environment of a dishwashing machine. The disintegration rate of the coating layer determines, in part, the time interval between the start of the dishwashing cycle when the encapsulated particle is introduced into the dishwashing machine and the dissolution of the core, including the wash additive(s).

The coating layer should be adjusted to have a melting point greater than about 65° C. (150° F.) and preferably is between about 70° C. and about 75° C. Preferably, the coating layer makes up about 1–25%, and more preferably about 2.5 –15%, by weight, of the coated particle.

A preferred coating composition comprises a major proporation, i.e., 70–85%, of a solid fatty acid or fatty acid blend, i.e., a waxy blend of ($C_{18}$–$C_{36}$) fatty acids having a melting point range of about 70°–75° C. Such a fatty acid blend is available as Syncrowax AW1-C (Croda, Inc., Madison Avenue, N.Y.). The fatty acid blend is combined with a minor amount of an amount (about 15–30%) of a mixture of ethylene glycol esters of ($C_6$–$C_{22}$) fatty acids. Preferably the ester mixture is a mixture of a monoethylene oxide ester of a ($C_6$–$C_{22}$) fatty acid and a polyethylene oxide ester of a ($C_6$–$C_{22}$) fatty acid, i.e., the 35–45 mole ethylene oxide ester of a ($C_{16}$–$C_{22}$) fatty acid, e.g., stearic acid, lauric acid, octadeanoic acid and the like. Both the higher ethylene oxide esters and the monoethylene (and di-) oxide esters are available as the LIPO-PEG series, e.g., LIPO PEG 20-S, 39-S and 100-S and as LIPO EGMS (and EGDS), respectively from Lipo Chemicals, Inc., Patterson, N.J. Preferably, the weight ratio of mono ester to 35–45 mole ester is about 0.5–1:1.

The coating composition is applied to a core particle which comprises one or more wash additives, such as the preferred rinse aids. The core particle is preferably formed of one or more solid, absorbent particulate materials, which may be agglomerates of one or more types of smaller particulates. Preferred as matrices for the core particles are the inorganic builder or filler salts disclosed hereinabove including phosphates, carbonates, silicates, chlorides, and the like.

The coated particles can be any suitable shape such as round, cylindrical, hexagonal, square, or cylindrical with truncated faces, etc. As will be appreciated, the particles are particularly useful when placed in a prewash or a main wash dispenser of a dishwashing machine. Consequently, particle dimensions are preferably selected such that the encapsulated particle or particles, along with any other composition ingredients, will fit in the prewash and/or the main wash dispenser of a dishwashing machine. They can vary widely in size, e.g., from microparticulate (microcapsule) size to several um in diameter. Particles about 100–2,500 um in diameter are preferred.

The core particles of the present invention can comprise about 5–40%, preferably about 10–35% of one or more wash additives, which act to improve the performance of the present dishwashing composition in the rinse cycle of the dishwasher. Preferred for use in the core particles is about 10–25% of a nonionic surfactant, or surfactant blend, that functions as an effective rinse aid, to reduce the amount of water retained on the washed dishes, other kitchenware, labware, etc., prior to drying. This reduction, in ram, reduces the amount of streaking and spotting on the ware, and gives it a cleaner appearance.

Nonionic surfactants useful in the present invention are generally esters or ethers comprising polymers or copolymers of ($C_2$–$C_3$)alkylene glycols, i.e., polyoxyethylene or polyoxypropylene esters or ethers, particularly of fatty alcohols, fatty acids, glycols, or phenols.

Preferred nonionic surfactants include the condensation products of ($C_8$–$C_{22}$)alkyl alcohols (alkanols) with 2–50 moles of ethylene oxide, preferably 35–45 moles, per mole of alcohol. Examples of compounds of this type include the condensation products of ($C_{11}$–$C_{15}$) fatty alcohols with 3–50 moles of ethylene oxide per mole of alcohol which are commercially-available from Shell Chemical Col, Houston, Tex., i.e., Neodol® 23–6.5 ($C_{12}$–$C_{13}$ fatty alcohol condensed with about 7 moles of ethylene oxide). The Poly-Tergent® SLF series from Olin Chemicals or the Tergitol® series from Union Carbide, e.g., Tergitol® 15-S-15, which is formed by condensing about 15 moles of ethylene oxide with a $C_{11}$–$C_{15}$ secondary alkanol; and Tergitol® TMN-6, which is the condensation product of about 6 moles of ethylene oxide with isolauryl alcohol (CTFA name: isolaureth-6). Another commercially available nonionic surfactant of this class is the condensation product of lauryl alcohol with about 11–40 moles of ethylene oxide, e.g., Lipocol® L-23 ($OEt_{23}$) (Lipo Chemicals, Inc., Patterson, N.J.). A further useful series of these compounds are the Plurafac® linear alcohol alkoxylates available from BASF-Wyandott Corp., i.e., Plurafac RA-40 (m.w. 820) and Plurafac RA-43.

Other useful nonionic surfactants includes the block copolymers formed by condensing ethylene oxide with a hydrophobic polyoxyalkylene base formed by the condensation of propylene oxide with propylene glycol. The hydrophobic portion of these compounds has a molecular weight sufficiently high so as to render it water-insoluble. The addition of polyoxyethylene moieties to this hydrophobic portion increases the water solubility of the molecule as a whole, and the liquid character of the product is retained up to the point where the polyoxyethylene content is about 50% of the total weight of the condensation production. Examples of compounds of this type include certain commercially-available Pluronic® surfactants (BASF Wyandotte Corp., Wyandotee, Mich.), especially those in which the polyoxypropylene ether has a molecular weight of about 1500–3500 and the polyoxyethylene content is about 15–35% of the molecule by weight, i.e., Pluronic® L-62, L-72 and L-92.

Other nonionic surfactants which may be employed include the ethylene oxide esters of $C_6$–$C_{12}$ alkyl phenols such as (nonylphenoxy)polyoxyethylene ether. Particularly useful are the esters prepared by condensing about 8–12 moles of ethylene oxide with nonylphenol, i.e., the Igepal® CO series (GAF Corp., New York, N.Y.).

Other useful nonionics include the ethylene oxide esters of alkyl mercaptans such as dodecyl mercaptan polyoxyethylene thioether, the ethylene oxide esters of fatty acids such as the lauric ester of polyethylene glycol and the lauric ester of methoxypolyethylene glycol, the ethylene oxide ethers of fatty acid amides, the condensation productions of ethylene oxide with partially fatty acid esters of sorbitol such as the lauric ester of sorbitan polyethylene glycol ether, and other similar materials, wherein the mole ratio of ethylene oxide to the acid, phenol, amide or alcohol is about 5–50:1.

Other nonionic surfactants useful as rinse aids in the present invention are disclosed by Chun et al. (U.S. Pat. No. 5,133,892).

It is also preferred to include a minor but effective amount, i.e., about 0.5–10% of the present core particles of a polymeric agent which promotes dispersion of the core particles throughout the dishwasher, and adherence to the surfaces thereof. Such an agent improves the efficiency of delivery of the other wash additives since undissolved core particles will remain in the dishwasher throughout more than one cycle. Useful agents of these types include polyvinylpyprolidones (PVP) available from GAF.

Minor but effective amounts of fragrance selected so as to be chemically-compatible with the above-described ingredients are preferably included in the compositions of the present invention for aesthetic purposes. Useful fragrances will include, for instance, about 0.025–2% preferably about 0.05–1.5% of floral oils such as rose oil, lilac, jasmine, wisteria, apple blossom or compound bouquets such as spice, aldehydic, woody, oriental and the like.

The present coated particles can be readily prepared by methods known to the art for applying coherent coating films to particulate solids. Such methods include spraying solutions of the coating ingredients in a volatile solvent onto a moving bed of the core particles, which have been pretreated to absorb the desired amounts of the wash additives. For example, in Alterman et al. (U.S. Pat. No. 3,908,045), a fatty acid coating material was sprayed onto bleach particles. In Mazola (U.S. Pat. No. 4,078,099), a rotating dram device was used to apply the coating material. Ames et al. (U.S. Pat. No. 4,759,956) disclose coating a core material held in a fluidized bed. See also, Kamel et al. (U.S. Pat. No. 5,230,822).

The following examples illustrate the dishwashing compositions of the present invention and methods of use of the Compositions.

EXAMPLE 1

Encapsulated particles containing a rinse aid were manufactured as follows.

To a rotary dram agglomerator was added 62.8 g sodium tripolyphosphate particles, which were sprayed with 16.9 g of nonionic surfactant rinse aid (Plurafac RA-43) and sprinkled with 6.0 g of polyvinylpyrrolidone powder (PVP K-90).

Meanwhile, a mixing vessel was charged with 38 ml water and heated to 80° C. The mixing vessel should be kept covered to prevent water loss. Lipopeg 39S (2.0 g) was slowly added to the vessel, which was agitated until a clear solution was obtained. In a separate vessel, 50.0 g of a fatty acid blend (Syncrowax AWl-C), 6.0 g (Lipopeg 39S) and 4.0 g of the monoethylene oxide ester of stearic acid (Lipo EGMS) were heated to 80° C. and blended until the mixture was uniform. The wax blend was slowly added to the water phase via sub-surface addition. Care was taken to avoid entrapping air into the emulsion. The resulting suspension was mixed for about 5–10 minutes until a uniform milky white emulsion was formed. While maintaining a temperature of 80° C., the emulsion blend was sprayed onto the surfactant-containing particles in the rotary dram agglomerator. After 14.5 g of the emulsion blend was sprayed, the particles were rambled for 1 minute in order to assure uniformity. The particles were dried at 63° C. for 18 hrs, cooled and passed through a 4 mesh screen.

Particles having the "9% coating" composition shown on Table 1 were obtained. The 5% coating weight was obtained by spraying 8.0 g of emulsion blend onto 69.3 g of sodium tripolyphosphate coated with 15.0 g of surfactant and 6.0 g of PVP K-90.

TABLE 1

| | 9% COATING | 5% COATING | 0% COATING |
|---|---|---|---|
| Sodium Tripolyphosphate | 62.81 | 69.27 | 77.33 |
| Plumfac RA-43 | 15.00 | 15.00 | 15.00 |
| PVP K-90 | 6.00 | 6.00 | 6.00 |
| Syncrowax AW1-C | 7.26 | 4.03 | — |
| Lipo 39S | 1.16 | .65 | — |
| Water | 7.19 | 4.73 | 1.67 |
| Total | 100.00g | 100.00g | 100.00g |

Rinse aid particles of each of the formulations of Example 1 were combined with Electrasol Auto Dish Detergent and tested to determine the amount of residual water left on dishes normally washed in an automatic dishwasher as follows. The ratio was 80% Electrasol +20% rinse aid particles.

A food soil preparation containing 70% margarine (Parkay Brand), 5% powdered milk (Camation Brand) and 15% cooked cereal (Quaker Brand) was prepared in accord with ASTM 3SS60. A General Electric Potscrubber 650 dishwasher was set to a temperature of 125° F.±5° F. The water source was set to 300 ppm hardness (measured as $CaCO_3$).

40 grams of food soil were spread on seven 11" black dinner plates. The plates and eight 8" black salad plates, six 7½" green salad plates, four spoons, six forks and six knives were placed on the bottom rack of the dishwasher. On the top rack were placed twelve 6½" black saucers, ten 8 oz. straight wall glasses and eight 250 ml beakers. 50 grams of the dishwashing detergent composition were added to the dispensing cups located on the door of the dishwasher (30 grams in closed cup and 20 grams in open cup). The machine was set to normal wash cycle with heated drying.

When the machine cycle reached the final rinse cycle, the door was opened and 10 mLs of a 5% solution of acid blue #9 dye were added. The machine door was closed and the rinse cycle continued. Immediately before the final rinse water pumped out, the door was opened and a 10 ml sample of the rinse water (sump) was removed using a volumetric pipet.

Once drying was complete, 500 ml of distilled water were placed into a 20 liter stainless steel pot. Each article from the dishwasher was rinsed in the 500 ml of distilled water so that the blue dye was accumulated in the same 500 ml of distilled water. All articles were rinsed, starting with the bottom rack, except the 8–250 ml beakers. These beakers are used simply to fill void spaces in the dishwasher.

A 1:10 dilution of the rinse water sample (sump) was prepared. Absorbance at wavelength 630 um was determined using a Spectronic 21 D for the water sample in which all of the articles were rinsed in the 10% rinse water solution. The water left on the substrates after drying was calculated as follows:

$$\text{Mean mls. of water on substrates} = \frac{2\times \text{mean absorbance on substrates}}{\text{absorbance rinse water}}$$

The results are shown on Table 2, below.

TABLE 2

| % Wax Coating | ml Residual Water[1] |
|---|---|
| 0 | 1.000 |
| 5 | 0.637 |
| 9 | 0.513 |

[1]The data has been normalized to one.

EXAMPLE 3

Encapsulated particles were manufactured according to Example 1 using a variety of builder salts in the core. The core particles were sprayed with surfactant according to Example 1 and coated with an emulsion blend to yield a barrier layer corresponding to 5% of the total weight of the particle, except for formulation H, which received a 7% barrier layer. The composition of the finished coated particles are listed on Table 3, below.

TABLE 3

| | CORE PARTICLE FORMULATION DIVERSITY | | | |
|---|---|---|---|---|
| MATERIAL | GK-6-38-I | GK-6-38-IV | GK-6-39-IX | GK-6-39-X |
| NaTPP | 83.57 | — | — | — |
| DENSE SODA ASH | — | 85.23 | 60.80 | 60.80 |
| SODIUM CITRATE | — | — | 26.10 | — |
| SODIUM CHLORIDE | — | — | — | 26.10 |
| PLURAFAC RA-43 | 7.50 | 6.00 | 4.50 | 4.50 |
| LIPOPEG 39S | 0.65 | 0.65 | 0.65 | 0.65 |
| LIPO EGMS | 0.32 | 0.32 | 0.32 | 0.32 |
| SYNCROWAX AWI-C | 4.05 | 4.05 | 4.05 | 4.05 |
| WATER | 3.91 | 3.75 | 3.58 | 3.58 |
| TOTAL: | 100.00 | 100.00 | 100.00 | 100.00 |

Encapsulated particles containing a rime aid inner component manufactured according to Example 3 were combined with Electrasol Auto Dish Detergent and tested to determine the amount of residual water left on dishes normally washed in a Whirlpool automatic dishwasher. The ratio was 80% Electrasol +20% rinse aid particle. A trial using 100% Electrasol was run for comparison. Residual rinse water volumes were determined according to the procedure of Example 1. The results are shown in Table 4.

TABLE 4

| Formulation | ml Residual Water[1] |
|---|---|
| Electrasol | 1.000 |
| A | 0.340 |
| B | 0.312 |
| C | 0.237 |
| D | 0.294 |
| E | 0.292 |
| F | — |
| G | 0.321 |
| H | 0.265 |

[1]The data has been normalized to one.

As shown by the date on Tables 2 and 4, the addition of the coated rinse aid particles of the present invention to a particulate dishwashing detergent substantially reduces the amount of water retained on the washed ware, thus substantially reducing spotting and streaking.

All publications, patents and patent documents are incorporated by reference herein, as though individually incorporated by reference. The invention has been described with reference to various specific and preferred embodiments and techniques. However, it should be understood that many variations and modifications may be made while remaining within the spirit and scope of the invention.

What is claimed is:

1. A delayed-release composite particle consisting essentially of:

(a) a core particle comprising about 70–95 wt-% of an inorganic detergent builder salt and about 5–30 wt-% of a nonionic surfactant rinse aid; and (b) a waxy coating encapsulating said core particle, which coating comprises a major amount of not more than about 85 wt-% of a solid fatty acid or solid fatty acid blend and a minor amount of at least about 15 wt-% of a mixture of ethylene oxide esters of ($C_{16}$–$C_{22}$) fatty acids having at least one ethylene oxide so that the coating has a melting point of greater than the operating temperature of the dishwashing machine and which chemically disintegrates in aqueous solution at a temperature of less than about 65° C. and at a pH of above about 9.0 wherein the core particle comprises about 75–99 wt-% of the composite particle and wherein the coating comprises about 1–25 wt-% of the composite particle.

2. The composition of claim 1 wherein said particulate detergent further comprises an enzyme.

3. A method of dishwashing comprising the steps of placing in an automatic dishwashing machine with soiled ware an effective amount of a composition comprising:

(i) about 50–95% by weight of a particulate detergent capable of providing an alkaline washing solution having a pH greater than about 9.0 during a dishwashing cycle in said dishwashing machine; and (ii) about 5–50% by weight of composite particles consisting essentially of 77–99 wt-% of an inner core comprising a water soluble support matrix and a nonionic surfactant rinse aid, wherein said core is encapsulated by about 1–25 wt-% of a waxy coating comprising, a major amount of not more than about 85 wt-% of a solid fatty acid or solid fatty acid blend and a minor amount of at least about 15 wt-% of a mixture of ethylene oxide esters of ($C_{16}$–$C_{22}$) fatty acids having at least one ethylene oxide so that the coating has a melting point greater than the operating temperature of said dishwashing machine, wherein said coating chemically disintegrates and is solubilized during said dishwashing cycle, thereby dissolving said core at a time later than the start of said dishwashing cycle, so that an effective amount of said rinse aid is delivered to the rinse cycle of said dishwashing machine; and (b) operating said dishwashing machine.

4. A composition suitable for use in a dishwashing machine, said composition comprising:

(a) about 50–95% by weight of a particulate detergent capable of providing an alkaline washing solution having a pH greater than about 9.0 during a dishwashing cycle in said dishwashing machine; and (b) about 5–50% by weight of composite particles consisting essentially of about 77–99 wt-% of an inner core comprising a water soluble support matrix and a nonionic surfactant rinse aid, wherein said core is encapsulated by about 1–25 wt-% of a waxy coating comprising a major amount of not more than about 85 wt-% of a solid fatty acid or solid fatty acid blend and a minor amount of at least about 15 wt-% of a mixture of ethylene oxide esters of ($C_{16}$–$C_{22}$) fatty acids having at least one ethylene oxide so that the coating has a melting point greater than the operating temperature of said dishwashing machine, wherein said coating chemically disintegrates and is solubilized during said dishwashing cycle, thereby dissolving said core at a time later than the start of said dishwashing cycle, so that an effective amount of said rinse aid is delivered to the rinse cycle of said dishwashing machine.

5. The composite particle of claim 1 wherein the mixture of ethylene oxide esters of ($C_{16}$–$C_{22}$)fatty acids comprises a mixture of the monoethylene oxide ester of stearic acid and a polyethylene oxide ester of stearic acid.

6. The composite particle of claim 1 wherein the inorganic detergent builder salt is sodium tripolyphosphate.

7. The composite particle of claim 1 wherein the nonionic surfactant rinse aid is a polyethylene oxide ether of a ($C_8$–$C_{22}$) fatty alcohol.

8. The composite particle of claim 1 wherein the core particle further comprises about 5–10% polyvinylpyrrolidone.

9. A delayed-release composite particle comprising:

(a) a core particle comprising about 85–97.5 wt-% of the composite particle, wherein said core particle comprises about 70–95% of a water-soluble support matrix and about 5–30% of at least one wash additive; and (b) a waxy coating encapsulating said core particle which comprises about 70–85% of a blend of ($C_{18}$–$C_{36}$) fatty acids having a melting point range of about 70°–75° C. and about 15–30% of a mixture of the monoethylene oxide ester of a ($C_{16}$–$C_{22}$) fatty acid and the polyethylene oxide ester of a ($C_{16}$–$C_{22}$) fatty acid.

10. The composite particle of claim 9 wherein the support matrix comprises an inorganic detergent builder salt.

11. The composite particle of claim 9 wherein the wash additive comprises a nonionic surfactant rinse aid.

12. The composite particle of claim 11 wherein the wash additive comprises the condensation product of about 35–40 moles of ethylene oxide with a ($C_8$–$C_{22}$) alkanol.

13. The composite particle of claim 12 wherein the core particle comprises about 0.05–10% of polyvinylpyrrolidone.

14. The composition of claim 4 wherein said core further comprises a bleach.

15. The composition of claim 4 wherein said support matrix comprises an inorganic builder salt.

16. The composition claim 4 wherein said waxy coating has a melting point of above about 60° C.

17. The composition of claim 4 wherein said particulate detergent comprises an inorganic builder salt.

18. The composition of claim 15 wherein said support matrix comprises sodium tripolyphosphate.

19. The composition of claim 4 wherein said coating comprises a plurality of fatty acids having a melting point of about 60°–65° C.

20. The composition of claim 4 wherein said fatty acids have a carbon chain length of about 18–36,

21. The composition of claim 4 wherein said coating further comprises a plurality of ethylene glycol stearate esters.

22. The composition of claim 4 wherein said coating has a melting point greater than about 65° C.

23. The composition of claim 22 wherein said melting is about 70° C. to about 75° C.

24. The composition of claim 4 wherein said rinse aid comprises an ethylene oxide ether of a fatty alcohol,

25. The composition of claim 24 wherein said core further comprises polyvinylpyrrolidone.

* * * * *

UNITED STATES PATENT AND TRADEMARK OFFICE

CERTIFICATE OF CORRECTION

PATENT NO. : 5,453,216

DATED : September 26, 1995

INVENTOR(S) : George W. Kellett

It is certified that error appears in the above-indentified patent and that said Letters Patent is hereby corrected as shown below:

Col. 1, line 66, delete "alter" and insert --after--.

Col. 5, line 11, delete "ram" and insert --turn--.

Col. 6, line 39, delete "dram" and insert --drum--.

Col. 6, line 52, delete "dram" and insert --drum--.

Col. 7, line 4, delete "dram" and insert --drum--.

Col. 7, line 6, delete "rambled" and insert --tumbled--.

Col. 7, line 20, delete "Plumfac" and insert --Plurafac--.

Col. 8, line 65, delete "rime" and insert --rinse--.

Signed and Sealed this

Eleventh Day of June, 1996

*Attest:*

Bruce Lehman

BRUCE LEHMAN

*Attesting Officer*

*Commissioner of Patents and Trademarks*